US008276516B1

(12) United States Patent
Nance et al.

(10) Patent No.: US 8,276,516 B1
(45) Date of Patent: Oct. 2, 2012

(54) APPARATUS FOR DETONATING A TRIAMINOTRINITROBENZENE CHARGE

(75) Inventors: Christopher J. Nance, Middletown, CA (US); John Yelverton, Fort Walton Beach, FL (US); Charles Hart, Hidden Valley Lake, CA (US); Michael Meadows, Kelseyville, CA (US)

(73) Assignee: Reynolds Systems, Inc., Middletown, CA (US)

( * ) Notice: Subject to any disclaimer, the term of this patent is extended or adjusted under 35 U.S.C. 154(b) by 523 days.

(21) Appl. No.: 12/590,861

(22) Filed: Oct. 30, 2009

Related U.S. Application Data

(60) Provisional application No. 61/109,663, filed on Oct. 30, 2008.

(51) Int. Cl.
*F42B 3/10* (2006.01)
*F42B 3/11* (2006.01)
*C06C 5/06* (2006.01)

(52) U.S. Cl. ..... 102/275.11; 102/202.5

(58) Field of Classification Search ..... 102/202.5, 102/202.7, 202.8, 202.11, 275.11
See application file for complete search history.

(56) References Cited

U.S. PATENT DOCUMENTS 1,313,801 A 8/1919 Doran
2,415,045 A 1/1947 Seavey
3,945,322 A 3/1976 Carlson et al.
4,096,541 A 6/1978 Bohin et al.
4,103,619 A 8/1978 Fletcher et al.
4,144,814 A 3/1979 Day et al.
4,207,124 A 6/1980 Christe
4,261,263 A 4/1981 Coultas et al.
4,394,197 A 7/1983 Kabik et al.
4,428,292 A 1/1984 Riggs
4,481,371 A 11/1984 Benziger
4,541,342 A 9/1985 Routledge
4,600,960 A 7/1986 Clark
4,608,926 A 9/1986 Stevens
4,615,271 A 10/1986 Hutchinson
4,621,577 A 11/1986 Bickes, Jr. et al.
4,660,472 A 4/1987 Stevens
4,664,033 A 5/1987 Burkdoll et al.
4,669,384 A 6/1987 Chawla et al.
4,669,400 A 6/1987 Michaels et al.
4,735,145 A 4/1988 Johnson et al.
4,768,440 A 9/1988 Deneuville et al.
4,788,913 A * 12/1988 Stroud et al. ..... 102/202.5
4,829,765 A 5/1989 Bolieau et al.
4,840,122 A 6/1989 Nerheim
4,869,170 A 9/1989 Dahmberg et al.
4,891,730 A 1/1990 Saddow et al.
4,935,666 A 6/1990 McCann
4,938,137 A * 7/1990 Guay ..... 102/202.7
5,030,301 A 7/1991 Stout et al.
(Continued)

FOREIGN PATENT DOCUMENTS

JP 01248546 A 10/1989

*Primary Examiner* — Bret Hayes
(74) *Attorney, Agent, or Firm* — Harness, Dickey & Pierce, P.L.C.

(57) ABSTRACT

An apparatus for detonating an initiation charge that is formed of a secondary explosive, such as triaminotrinitrobenzene (TATB). The apparatus includes an exploding foil initiator, which can have a relatively small flyer that is suited to initiate a detonation event in the initiation charge.

20 Claims, 2 Drawing Sheets

U.S. PATENT DOCUMENTS 5,034,073 A 7/1991 Barry et al.
5,054,399 A 10/1991 Bilek et al.
5,080,016 A * 1/1992 Osher ..... 102/202.7
5,110,380 A 5/1992 Lee et al.
5,113,764 A 5/1992 Mandigo et al.
5,187,319 A 2/1993 Nouguez et al.
5,216,325 A 6/1993 Patel et al.
5,243,916 A 9/1993 Freche et al.
5,275,106 A 1/1994 Cutting et al.
5,320,043 A 6/1994 Andre et al.
5,347,929 A * 9/1994 Lerche et al. ..... 102/202.14
5,387,297 A 2/1995 Damavarapu et al.
5,411,290 A 5/1995 Chan et al.
5,444,598 A 8/1995 Aresco
5,495,806 A 3/1996 Willey
5,524,543 A 6/1996 Kerdraon
5,529,649 A 6/1996 Lund et al.
5,597,974 A 1/1997 Voreck, Jr. et al.
5,600,293 A 2/1997 Hunter
5,641,935 A 6/1997 Hunter et al.
5,641,997 A 6/1997 Ohta et al.
5,654,521 A 8/1997 McDaniel
5,678,856 A * 10/1997 Headley ..... 280/737
5,721,392 A 2/1998 Chan et al.
5,756,925 A 5/1998 Frank et al.
5,789,697 A * 8/1998 Engelke et al. ..... 102/202.5
5,855,827 A 1/1999 Bussing et al.
5,861,570 A 1/1999 Bickes, Jr. et al.
5,920,029 A 7/1999 Teaford
5,929,368 A 7/1999 Ewick et al.
5,959,236 A 9/1999 Smith et al.
5,969,286 A 10/1999 Ward et al.
6,079,332 A 6/2000 Marshall et al.
6,121,506 A 9/2000 Abel et al.
6,158,347 A 12/2000 Neyer et al.
6,178,888 B1 1/2001 Neyer et al.
6,199,905 B1 * 3/2001 Lewis ..... 280/737
6,227,115 B1 5/2001 Gruber et al.
6,230,625 B1 5/2001 Neyer et al.
6,234,081 B1 5/2001 Neyer
6,255,728 B1 7/2001 Nasiri et al.
6,276,276 B1 * 8/2001 Erickson ..... 102/201
6,305,286 B1 10/2001 Fogle, Jr. et al.
6,306,232 B1 10/2001 Khandhadia et al.
6,311,621 B1 11/2001 Marshall et al.
6,324,979 B1 12/2001 Troianello
6,357,355 B1 3/2002 Fogle, Jr.
6,408,758 B1 6/2002 Duguet
6,425,601 B1 7/2002 Lewis
6,463,857 B1 10/2002 Schmid et al.
6,467,414 B1 10/2002 Fisher
6,470,802 B1 10/2002 Neyer et al.
6,547,899 B2 4/2003 Lee et al.
6,568,331 B2 5/2003 Hofmann et al.
6,578,486 B2 6/2003 Mattes et al.
6,591,754 B1 7/2003 Baur et al.
6,615,737 B2 9/2003 Bonnel et al.
6,640,718 B2 11/2003 Duguet et al.
6,659,010 B2 12/2003 Goernig et al.
6,732,655 B1 5/2004 Jakob et al.
6,739,264 B1 5/2004 Hosey et al.
6,753,922 B1 6/2004 Sengupta et al.
6,810,815 B2 11/2004 Mueller-Fiedler et al.
6,851,370 B2 2/2005 Reynolds et al.
6,915,744 B2 7/2005 Tirmizi
6,923,122 B2 8/2005 Hennings et al.
6,977,468 B1 12/2005 Baginski
7,161,790 B2 1/2007 Matsuda et al.
7,343,859 B2 3/2008 Matsuda et al.
7,430,963 B2 10/2008 Hennings et al.
7,543,532 B2 6/2009 Nance
7,552,680 B2 6/2009 Nance et al.
7,571,679 B2 8/2009 Nance
7,581,496 B2 9/2009 Hennings et al.
7,614,344 B2 11/2009 Oda
2002/0079030 A1 6/2002 Chan et al.
2002/0129880 A1 * 9/2002 Lee et al. ..... 149/105
2005/0235858 A1 10/2005 Reynolds et al.
2007/0095236 A1 5/2007 Maruyama et al.
2007/0119325 A1 * 5/2007 Hennings et al. ..... 102/202.9
2007/0163457 A1 7/2007 Matsumura et al.
2009/0056584 A1 3/2009 Hennings et al.

* cited by examiner

APPARATUS FOR DETONATING A TRIAMINOTRINITROBENZENE CHARGE

CROSS-REFERENCE TO RELATED APPLICATION

This application claims the benefit of U.S. Provisional Application No. 61/109,663 filed Oct. 30, 2008, which is incorporated by reference in its entirety as if fully set forth in detail herein.

STATEMENT REGARDING FEDERALLY SPONSORED RESEARCH

The work reported herein was supported by the United States Air Force pursuant to SBIR grant FA8651-07-C-0101. The United States Government may have certain rights to the invention.

INTRODUCTION

The present invention generally relates to an apparatus for detonating a charge formed of a secondary explosive, such as a charge formed of triaminotrinitrobezene.

Triaminotrinitrobenzene (TATB) is a secondary explosive that is so relatively insensitive to shock, vibration, fire and impact and as such, it can be extremely difficult to detonate. Lawrence Livermore National Laboratory and the U.S. Air Force have speculated that even the most easily detonated forms of TATB would not sustain an initiation if the initiation charge was sized below a diameter of 3-4 millimeters. Conventional exploding foil initiators that have a 3-4 millimeter diameter require too much energy to feasibly weaponize. In view of the difficulties associated with direct initiation of TATB, weapons systems typically include a booster charge formed of another secondary explosive, which is relatively less insensitive than TATB. Detonation of the booster charge is employed to detonate a TATB main charge. The use of a booster charge formed of another, relatively less insensitive secondary explosive is known to have several drawbacks and consequently, a relatively small, weapons-grade detonation system for directly detonating a TATB charge without the use of other explosive materials is desired.

SUMMARY

This section provides a general summary of some aspects of the present disclosure and is not a comprehensive listing or detailing of either the full scope of the disclosure or all of the features described therein.

In one form, the present teachings provide a device for initiating a detonation event in a main charge. The device can include a sleeve, an initiation charge and an exploding foil initiator. The sleeve can define an initiation charge aperture having a first portion and a second portion. The initiation charge can be received in the entirety of the first and second portions of the initiation charge aperture. The exploding foil initiator can be abutted against the initiation charge and can be activatable to detonate the initiation charge. The first portion of the initiation charge aperture is configured to propagate a detonation wave front through the initiation charge in the initiation charge aperture. The second portion of the initiation charge aperture can diverge outwardly from the first portion to a predetermined diameter that is greater than about 3 mm.

In another form, the present teachings provide a device for initiating a detonation event in a main charge. The device includes an initiation charge, which is formed entirely of TATB, and an exploding foil initiator abutted against the initiation charge. The exploding foil initiator is activatable to detonate the initiation charge. The exploding foil initiator has a flyer with a surface area that is less than 0.011 square inches (7.07 square millimeters).

In still another form, the present teachings provide a method for initiating a detonation event in a main charge. The method includes: providing an initiation charge formed only of TATB; impacting the initiation charge with a flyer to initiate a detonation event in the initiation charge in which the initiation charge releases energy; controlling the energy released by the initiation charge to form a self-sustaining wave front in a first portion of the initiation charge; and propagating the self-sustaining wave front in a second portion of the initiation charge in directions both radially and axially outwardly from the first portion of the initiation charge. Controlling the energy released by the initiation charge includes confining the first portion of the initiation charge to direct the energy released by the first portion of the initiation charge into the initiation charge.

Further areas of applicability will become apparent from the description provided herein. It should be understood that the description and specific examples in this summary are intended for purposes of illustration only and are not intended to limit the scope of the present disclosure, its application and/or uses in any way.

BRIEF DESCRIPTION OF THE DRAWINGS

The drawings described herein are for illustrative purposes only and are not intended to limit the scope of the present disclosure in any way. The drawings are illustrative of selected teachings of the present disclosure and do not illustrate all possible implementations. Similar or identical elements are given consistent identifying numerals throughout the various figures.

DETAILED DESCRIPTION OF THE VARIOUS EMBODIMENTS

Figure 1:
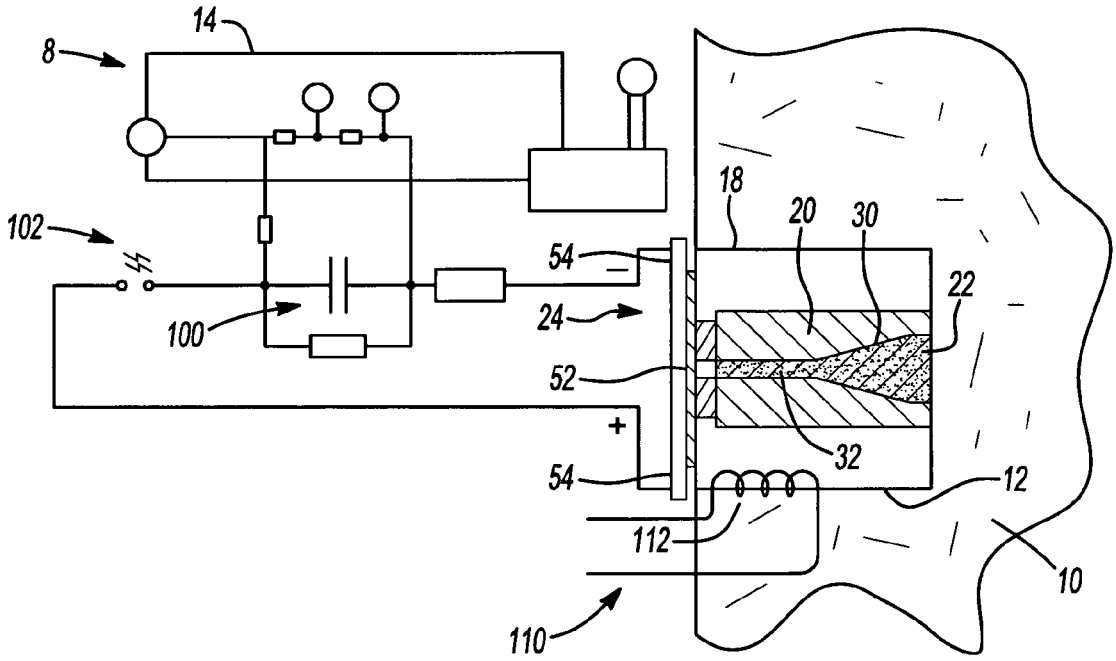
FIG. 1 is a schematic illustration of a device for detonating a triaminotrinitrobenzene charge constructed in accordance with the teachings of the present disclosure, the device being integrated into a main charge of triaminotrinitrobenzene.

With reference to FIG. 1 of the drawings, a device constructed in accordance with the teachings of the present disclosure is generally indicated by reference numeral 8. The device 8 can include a main charge 10, an initiator 12 and a fire set 14. The main charge 10 can be wholly formed of TATB. The initiator 12 can include a housing 18, a sleeve 20, an initiation charge 22 and an exploding foil initiator 24. The sleeve 20, the initiation charge 22 and the exploding foil initiator 24 can be received into the housing 18. The housing 18 can be hermetically sealed.

Figure 2:
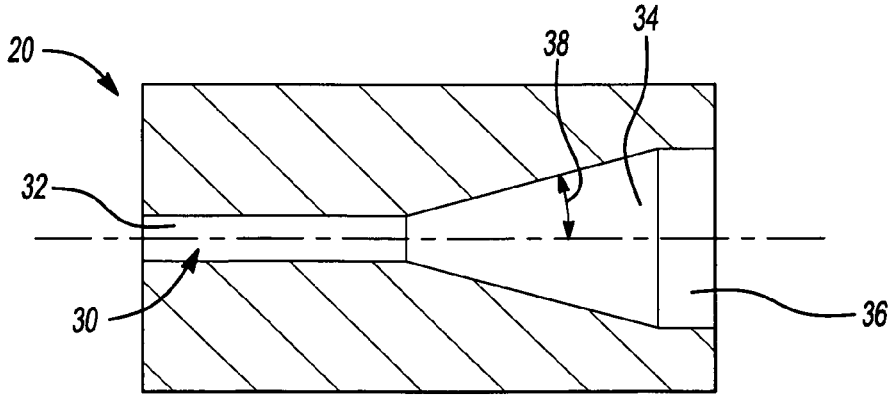
FIG. 2 is a longitudinal cross sectional view of a portion of the device of FIG. 1 illustrating a sleeve in more detail.

With additional reference to FIG. 2, the sleeve 20 can be configured to hold the initiation charge 22 and confine the energy that is produced when the initiation charge 22 is detonated, as will be discussed in further detail below. The sleeve 20 can be formed of a suitable material, such as tungsten, steel, brass, or aluminum, and can define an initiation charge aperture 30 into which the initiation charge 22 can be received. The initiation charge aperture 30 can have a first portion 32, a second portion 34 and a third portion 36 that can be oriented in a desired manner. In the particular example provided, each of the first, second and third portions 30, 32 and 36 has a longitudinal axis that is coincident with the longitudinal axes of the other two of the first, second and third portions 30, 32 and 36. The first portion 32 can have a relatively uniform lateral cross-sectional area (i.e., a cross-sectional area taken perpendicular to the longitudinal axis of the first portion 30) that can be relatively small. In the particular example provided, the first portion 32 is generally cylindrical in shape, but those of skill in the art will appreciate from this disclosure that other shapes, such as oval or rectangular, can be employed. The cross-sectional area of the first portion 32 can be greater than or equal to about 0.0050 square inch (e.g., 0.040 inch diameter when employing a shape with a circular cross-section), such as between about 0.0079 square inch (e.g., 0.050 inch diameter when employing a shape with a circular cross-section) to about 0.0201 square inch (e.g., 0.080 inch diameter when employing a shape with a circular cross-section). The length of the first portion 32 can be chosen to achieve a sustained, self-feeding detonation wave front when the portion of the initiation charge 22 received therein is initiated. In the particular example provided, the first portion 32 has a diameter of about 0.050 inch and the length of the first portion 32 is about 0.250 inch.

The second portion 34 can be sized and shaped to cause a wave front emanating from the portion of the initiation charge 22 that is received in the first portion 32 to propagate outwardly in both the longitudinal (i.e., axial) direction and a "radially" outward direction. The second portion 34 can be configured to diverge outwardly and away from the first portion 32 in a desired manner and can be frusto-conically shaped. For example, the second portion 34 can be configured to diverge outwardly and away from the first portion 32 such that a cross-sectional area of the portion of the second portion 34 immediately adjacent to the third portion 36 is greater than or equal to about 0.0438 square inch (e.g., 3.0 mm in diameter when the second portion 34 is frusto-conically shaped), and more preferably greater than or equal to about 0.0780 square inch (e.g., 4.0 mm in diameter when the second portion 34 is frusto-conically shaped). In the particular example provided, the second portion 34 has a frusto-conical shape with a cone angle 38 of that is greater than or equal to about 10 degrees and less than or equal to about 20 degrees, such as about 15.5 degrees, and the cross-sectional area at the point where the second and third portions 34 and 36 intersect is about 0.0962 square inch (i.e., 0.175 inch/4.445 mm in diameter), but it will be appreciated that other diverging shapes could also be employed. Such diverging shapes can include shapes that are wholly/completely diverging at all points between the first and third portions 32 and 36, and shapes that can generally diverge between the first and third portions 32 and 36. In our testing, we have noted that shallower angles of divergence in a frusto-conically shaped second portion 34 of the initiation charge aperture 30 tends to propagate the wave front through the initiation charge 22 in a more reliable manner.

The third portion 36 can be configured to be abutted against the main charge 10. In the example provided, the third portion 36 has a uniformly sized cross-sectional area that is sufficient to permit the wave front to propagate through the main charge 10. For example, the third portion 36 can have a diameter that is greater than or equal to about 3.0 mm, and preferably a diameter that is greater than or equal to about 4.0 mm.

Returning to FIG. 1, the initiation charge 22 can be wholly formed of TATB or of one or more secondary explosives, such as RSI-007 marketed by Reynolds Systems Incorporated of Middletown, Calif. In the particular example provided, the initiation charge 22 is wholly formed of Ultra Fine TATB developed by Lawrence Livermore National Laboratory (LLNL) and manufactured by BWXT Pantex, L.L.C. of Amarillo, Tex. Ultra Fine TATB is a type of TATB having a relatively small particle size with relatively larger surface area as compared with conventional TATB. The initiation charge 22 can be packed into the initiation charge aperture 30 in the sleeve 20 to achieve a density of about 1.7 grams/cm$^3$ to about 1.8 grams/cm$^3$, but other densities can be employed. It will be appreciated that the packing of the initiation charge 22 into the initiation charge aperture 30 causes the initiation charge 22 to have a shape conforming to that of the initiation charge aperture 30 and that in the particular example provided, the initiation charge 22 will have first, second and third portions that substantially conform in size and shape to the sizes and shape of the first, second and third portions 30, 32, and 34, respectively, of the initiation charge aperture 30.

Figure 3:
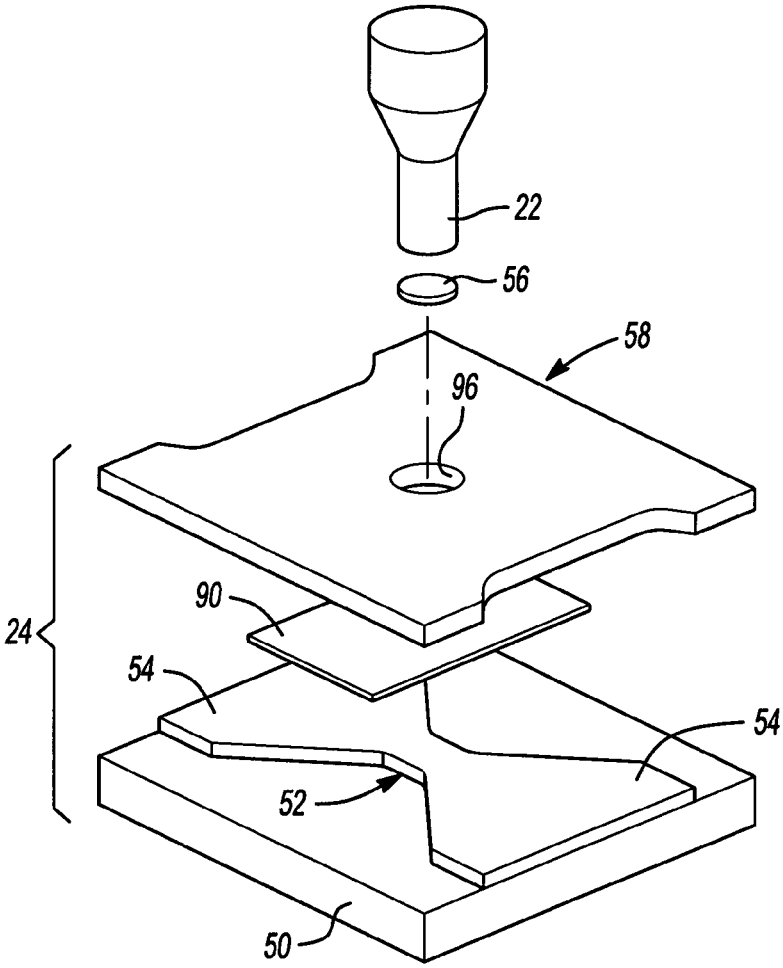
FIG. 3 is an exploded perspective view of a portion of the device of FIG. 1 illustrating the exploding foil initiator in more detail.

With reference to FIG. 3, the exploding foil initiator 24 can include a base or substrate 50, a bridge 52, a pair of bridge contacts 54, which are electrically coupled to opposite sides of the bridge 52, a flyer 56, and a barrel 58. The substrate 50 can be formed of an electrically insulating material, such as ceramic, glass, polyimide or silicon. The bridge 52 and the bridge contacts 54 can be formed of an appropriate electrically conductive material. In the particular example provided, the bridge 52 is a multi-layered component having an alumnia-ceramic layer, which is deposited onto the substrate 50, followed successively by a layer of nickel-chrome, a layer of copper, and a layer of nickel. In the example provided, the bridge contacts 54 are similarly formed, but include a layer of gold that is deposited over the layer of nickel. In the example provided, the alumina-ceramic layer has a thickness of about 0.020 inches, the layer of nickel-chrome has a thickness of about 1000-4000 Angstroms, the layer of copper has a thickness of about 8 to 15 microns, the layer of nickel has a thickness of about 1000-5000 Angstroms, and the layer of gold has a thickness of about 2-4 microns. As the layer of copper is relatively thick, processes including vapor jet deposition, multiple-pass vapor deposition and plating can be employed to form the layer of copper. The remaining layers can be formed by vapor deposition.

Figure 4:
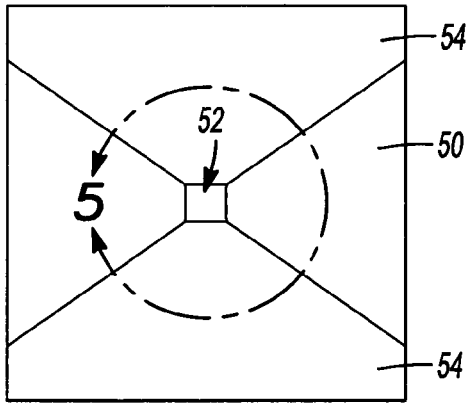
FIG. 4 is a top plan view of a portion of the exploding foil initiator, illustrating the substrate, the bridge and the bridge contacts in more detail.
Figure 5:
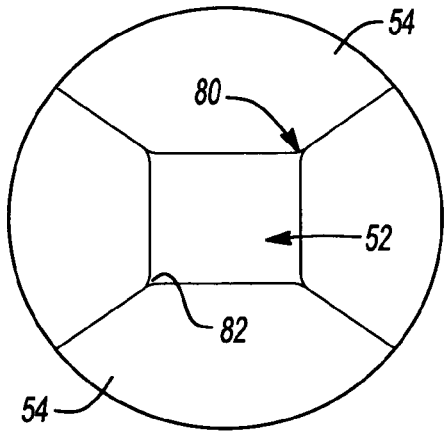
FIG. 5 is an enlarged view of a portion of FIG. 4.

With additional reference to FIGS. 4 and 5, the bridge 52 can have a generally square shape and can be sized to form a plasma that can propel the flyer 56 at a velocity that is sufficient to initiate a detonation event in the initiation charge 22. The bridge 52 can have a diameter that is less than or equal to about 3 mm (a surface area less than or equal to about 0.011 square inches/7.07 square millimeters). Preferably, the bridge 52 is sized to propel the flyer 56 at a velocity that is greater than or equal to about 5,000 meters per second (5 km/sec). In the particular example provided, the bridge 52 has a nominal size of 0.040 inch by 0.040 inch (a surface area of about 0.0016 square inch), except that a small fillet radius 80 (FIG. 5), such as a fillet radius of about 0.04 inch, can be employed at the transition between each of the corners 82 (FIG. 5) of the bridge 52 and the bridge contacts 54.

In FIG. 3, a layer of material that forms the flyer 56 (i.e., the flyer layer 90) can include a first sub-layer formed of a suitable electrically insulating material, such as polyimide or parylene, and a second sub-layer, that can be formed of an electrically conductive material, such as gold, and overlaid onto the first sub-layer. The flyer layer 90 can overlie the bridge 52 and portions of the bridge contacts 54. The flyer layer 90 can have a thickness that is greater than or equal to about 2 mils and preferably greater than or equal to about 3 mils.

The barrel 58 can be formed of a suitable electrically insulating material, such as polyimide, and can be bonded in place over the flyer layer 90. The barrel 58 can define a barrel aperture 96, which can cooperate with the flyer layer 90 to cause an appropriately sized piece of material (i.e., the flyer 56) to be sheared from the flyer layer 90 when the exploding foil initiator 24 is activated. The barrel aperture 96 can be sized such that the flyer 56 is sized about equal to the first portion 32 of the initiation charge aperture 30. In the particular example provided, the barrel aperture 96 has a diameter of about 0.045 inch to about 0.050 inch and a length of about 0.020 inch to about 0.025 inch. It will be appreciated, however, that the barrel length and diameter can be varied as desired. For example, the barrel diameter can be sized larger than the flyer 56, such as two or more times the diameter of the flyer 56 (e.g., 0.100 inch in diameter when a 0.040×0.040 inch bridge 52 is employed). As another example, the barrel length can be based in part on the surface area of the flyer 56 such that flyers such that longer barrels 58 are associated with flyers 56 having relatively higher surface area. Those of skill in the art will also appreciate that the barrel 58 can be abutted against the portion of the initiation charge 22 that resides in the first portion 32 of the initiation charge aperture 30 in the sleeve 20.

With reference to FIGS. 1 and 3, the fire set 14 can be generally conventional in its construction and operation and as such, need not be discussed in significant detail herein. Briefly, the fire set 14 can include a power source 100 and a switch 102 that can be operated to selectively couple the bridge contacts 54 to the power source 100 to cause electrical energy to flow through the bridge 52 such that the physical state or phase of the bridge 52 rapidly changes from a solid state to a plasma state. The change from solid state to plasma state can shear the flyer 56 from the flyer layer 90 and propel the flyer 56 through the barrel aperture 96. The relative velocity and mass of the flyer 56 can be configured to initiate a shock wave in the initiation charge 22 to cause the portion of the initiation charge 22 in the first portion 32 of the initiation charge aperture 30 to detonate. The heavy confinement provided by the sleeve 20 to the initiation charge 22 confines a significant portion of the energy of the detonation event within the initiation charge 22 so that a wave front is propagated through the initiation charge 22. In this regard, it will be appreciated that confining the portion of the initiation charge 22 in the first portion 32 of the initiation charge aperture 30 (i.e., the first portion of the initiation charge 22) directs energy released by the first portion of the initiation charge 22 into the initiation charge to stabilize the wave front of the shock wave that travels through the initiation charge 22. The configuration of the initiation charge aperture 30 promotes consistency in the manner in which the wave front propagates so that the wave front can reliably pass into and initiate a detonation event in the main charge 10.

Configured as described above, the apparatus 10 can be relatively small in volume, such as about 105 cubic inches (i.e., about the size of a 12 oz. soda can).

Optionally, the fire set 14 can include a heater 110, such as an electrically-powered or chemically-powered heater having one or more heating coils 112. The heater 110 can be operated to heat the initiation charge 22 to a temperature at which the initiation charge 22 may be more reliably detonated. For example, the heater 110 can heat the initiation charge 22 to a temperature of about 180° F.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein, even if not specifically shown or described, so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and the appended claims.

What is claimed is:

1. A device for initiating a detonation event in a main charge, the device comprising:

a sleeve defining an initiation charge aperture, the initiation charge aperture having a first portion and a second portion;

an initiation charge received in the entirety of the first and second portions of the initiation charge aperture; and an exploding foil initiator abutted against the initiation charge, the exploding foil initiator being activatable to detonate the initiation charge;

wherein the first portion is configured to propagate a detonation wave front through the initiation charge in the initiation charge aperture and wherein the second portion diverges outwardly from the first portion to a predetermined diameter that is greater than about 3 mm.

2. The device of claim 1, wherein the initiation charge is wholly formed of TATB.

3. The device of claim 2, wherein the device is contained in a volume that is less than or equal to about 105 cubic inches.

4. The device of claim 1, wherein the first portion of the initiation charge aperture has a uniform lateral cross-section as taken perpendicular to a longitudinal axis of the first portion.

5. The device of claim 4, wherein the first portion of the initiation charge aperture is cylindrically shaped.

6. The device of claim 1, wherein the first portion of the initiation charge aperture has a first longitudinal axis, wherein the second portion of the initiation charge aperture has a second longitudinal axis and wherein the first and second longitudinal axes are conincident.

7. The device of claim 1, wherein the second portion of the initiation charge aperture is frusto-conically shaped.

8. The device of claim 7, wherein the frusto-conical shape of the second portion is defined by a cone angle that is less than or equal to 20 degrees.

9. The device of claim 7, wherein the frusto-conical shape of the second portion is defined by a cone angle that is greater than or equal to 10 degrees.

10. The device of claim 1, wherein the exploding foil initiator comprises a flyer having a thickness of 0.015 inch to about 0.050 inch.

11. A device for initiating a detonation event in a main charge, the device comprising:

an initiation charge formed entirely of TATB; and an exploding foil initiator abutted against the initiation charge, the exploding foil initiator being activatable to detonate the initiation charge;

wherein the exploding foil initiator has a flyer with a surface area that is less than 0.011 square inches (7.07 square millimeters).

12. The device of claim 11, wherein a portion of the initiation charge that is contacted by the flyer has a diameter of about 0.05 inch.

13. The device of claim 11, wherein the flyer has a surface area of about 0.0016 square inches.

14. The device of claim 11, wherein the initiation charge has a first portion and a second portion and wherein the second portion diverges outwardly from the first portion.

15. The device of claim 14, wherein the second portion of the initiation charge is frusto-conically shaped.

16. The device of claim 15, wherein the frusto-conical shape of the second portion is defined by a cone angle that is less than or equal to 20 degrees.

17. The device of claim 16, wherein the frusto-conical shape of the second portion is defined by a cone angle that is greater than or equal to 10 degrees.

18. The device of claim 14, wherein the first portion of the initiation charge has a uniform lateral cross-section as taken perpendicular to a longitudinal axis of the first portion.

19. The device of claim 18, wherein the first portion of the initiation charge is cylindrically shaped.

20. A method for initiating a detonation event in a main charge, the method comprising:

providing an initiation charge formed only of TATB;

impacting the initiation charge with a flyer to initiate a detonation event in the initiation charge in which the initiation charge releases energy;

controlling the energy released by the initiation charge to form a self-sustaining wave front in a first portion of the initiation charge; and propagating the self-sustaining wave front in a second portion of the initiation charge in directions both radially and axially outwardly from the first portion of the initiation charge;

wherein controlling the energy released by the initiation charge comprises confining the first portion of the initiation charge to direct the energy released by the first portion of the initiation charge into the initiation charge.

* * * * *